US005167904A

United States Patent [19]

Stomp et al.

[11] Patent Number: 5,167,904

[45] Date of Patent: Dec. 1, 1992

[54] DEVICE FOR THE AUTOMATIC COUPLING OF A BLOWING-IN LANCE TO A MANIFOLD

[75] Inventors: Hubert Stomp, Luxembourg, Luxembourg; Daniel Fries, Arlon, Belgium; Serge Devillet, Bissen, Luxembourg

[73] Assignee: Paul Wurth S.A., Luxembourg

[21] Appl. No.: 716,720

[22] Filed: Jun. 17, 1991

[30] Foreign Application Priority Data

Jul. 4, 1990 [LU] Luxembourg ..... 87761

[51] Int. Cl.[5] ..... C21C 5/46

[52] U.S. Cl. ..... 266/226

[58] Field of Search ..... 266/226

[56] References Cited

U.S. PATENT DOCUMENTS 3,170,977 2/1965 Obenchain ..... 266/226

4,893,791 1/1990 Stomp et al. ..... 266/226

*Primary Examiner*—Melvyn J. Andrews

*Attorney, Agent, or Firm*—Fishman, Dionne & Cantor

[57] ABSTRACT

A device for automatically coupling a lance for injecting a fluid into a molten metal bath to a manifold for supplying the fluid to the lance includes means for hitching the lance rigidly to a lance-carrying carriage which can be displaced along a slide rail, and means ensuring the support of the manifold with respect to the lance-carrying carriage and enabling the manifold to be displaced vertically with respect to the lance-carrying carriage, or vice versa.

14 Claims, 7 Drawing Sheets

DEVICE FOR THE AUTOMATIC COUPLING OF A BLOWING-IN LANCE TO A MANIFOLD

TECHNICAL FIELD

The present invention relates to a device for the automatic coupling of a blowing-in lance to a manifold which is in communication with ducts conveying fluids intended to be injected into a molten metal bath through channels running through the lance.

BACKGROUND OF THE INVENTION

The subject of the present invention is, particularly, lances used for the conversion of cast iron into steel and which are dipped into the converter in order to inject the refining substances into the metal bath. For this purpose, these lances comprise a series of channels, generally concentric, for blowing in these substances and for cooling the lance.

U.S. Pat. No. 3,972,515 the disclosure of which is incorporated herein by reference, proposes a device for coupling such a lance leaktightly to a manifold which is in communication with the ducts supplying the lance with refining substances and with cooling liquid. The contact surfaces between the lance and the manifold must, of course, be designed as a leaktight surface in order to prevent any leakage of these gaseous and liquid substances, while the clamping between the manifold and the lance must be sufficiently powerful to preserve this leaktightness.

In the device known from the abovementioned document, the mounting of the lance on the manifold is effected manually with the aid of clamping bolts. In the device proposed in the document DE-Al-3,828,928, the mounting of the lance on the manifold is effected automatically via pivoting hooks actuated by hydraulic jacks.

In both of the two devices, the mounting between the lance and the manifold must not only ensure leaktightness at the joining surfaces, but also the support of the lance, given that the latter is carried by the manifold. If follows that a very rigid mounting is necessarily required between the lance and the manifold with the consequence that the manifold, the joint and the ducts are obligatorily exposed to the vibrations of the lance.

SUMMARY OF THE INVENTION

The object of the present invention is to provide an improved device of the above-described type, in which the coupling of the lance to the manifold is also effected automatically but in which, in contrast to the known devices, the contact and joining surfaces between the manifold and the lance are not exposed to the vibrations, or even the impacts which the lance is subjected to during its operation and its handling.

In order to achieve this objective, the automatic coupling device proposed by the present invention is essentially characterized by means for hitching the lance rigidly to the lance-carrying carriage, and by means ensuring the support of the manifold with respect to the lance-carrying carriage and enabling the manifold to be displaced vertically with respect to the lance-carrying carriage, or vice versa.

According to a first embodiment, the manifold is mounted to a manifold-carrying carriage which can either be made integral, via the manifold and the lance, with the lance-carrying carriage, or be immobilized, by gravity, with respect to the slide rail of the latter.

According to this first embodiment, the manifold can be mounted via resilient means on the manifold-carrying carriage. To this end, it can comprise a peripheral flange by means of which it is supported between three pairs of vertical springs fixed on a plate integral with the manifold-carrying carriage.

The lance-carrying carriage can be displaced via guide rollers with respect to the manifold-carrying carriage when the latter is immobilized with respect to the slide rail. This immobilization can be effected by a catch which can be displaced under the action of a jack in order to support the lance-carrying carriage with respect to the slide rail.

According to an alternative of this embodiment, the manifold-carrying carriage is supported by at least one jack mounted on the lance-carrying carriage in order to displace the manifold-carrying carriage when the lance is changed.

According to another embodiment, the manifold slides directly, without an intermediate manifold-carrying means, on the lance-carrying carriage and can be supported with respect to the latter either by a moveable catch or by a jack, as in the first embodiment.

In contrast to the known devices in which the lance is hitched rigidly to the manifold, the device proposed by the present invention provides for the lance to be hitched rigidly to the lance-carrying carriage and for the manifold to be supported via the lance-carrying carriage. The vibrations and impact to which the lance is exposed are therefore transmitted to the lance-carrying carriage. On the other hand, by virtue of its non-rigid suspension, the manifold can, when it is integral with the lance head, adapt to the vibrations of the latter without affecting the leaktightness in the region of its joint. with the lance.

With a view to the mounting of the lance on the manifold, the latter can comprise two hooks which pivot under the action of hydraulic jacks via connecting links which are eccentric with respect to the axis of the hooks.

With a view to the hitching of the lance to the lance-carrying carriage, the lance can comprise two pairs of journals, while the carriage comprises two pairs of supports, each equipped with notches for receiving and carrying the journals of the lance, while each of the notches is associated with a hook actuated by a jack in order to lock the journals in the notches and to connect the lance rigidly to the lance-carrying carriage.

BRIEF DESCRIPTION OF THE DRAWINGS:

Other features and characteristics will emerge from the detailed description of some advantageous embodiments given below, by way of illustration, with reference to the drawings in which.

DETAILED DESCRIPTION OF THE INVENTION

Figure 1:
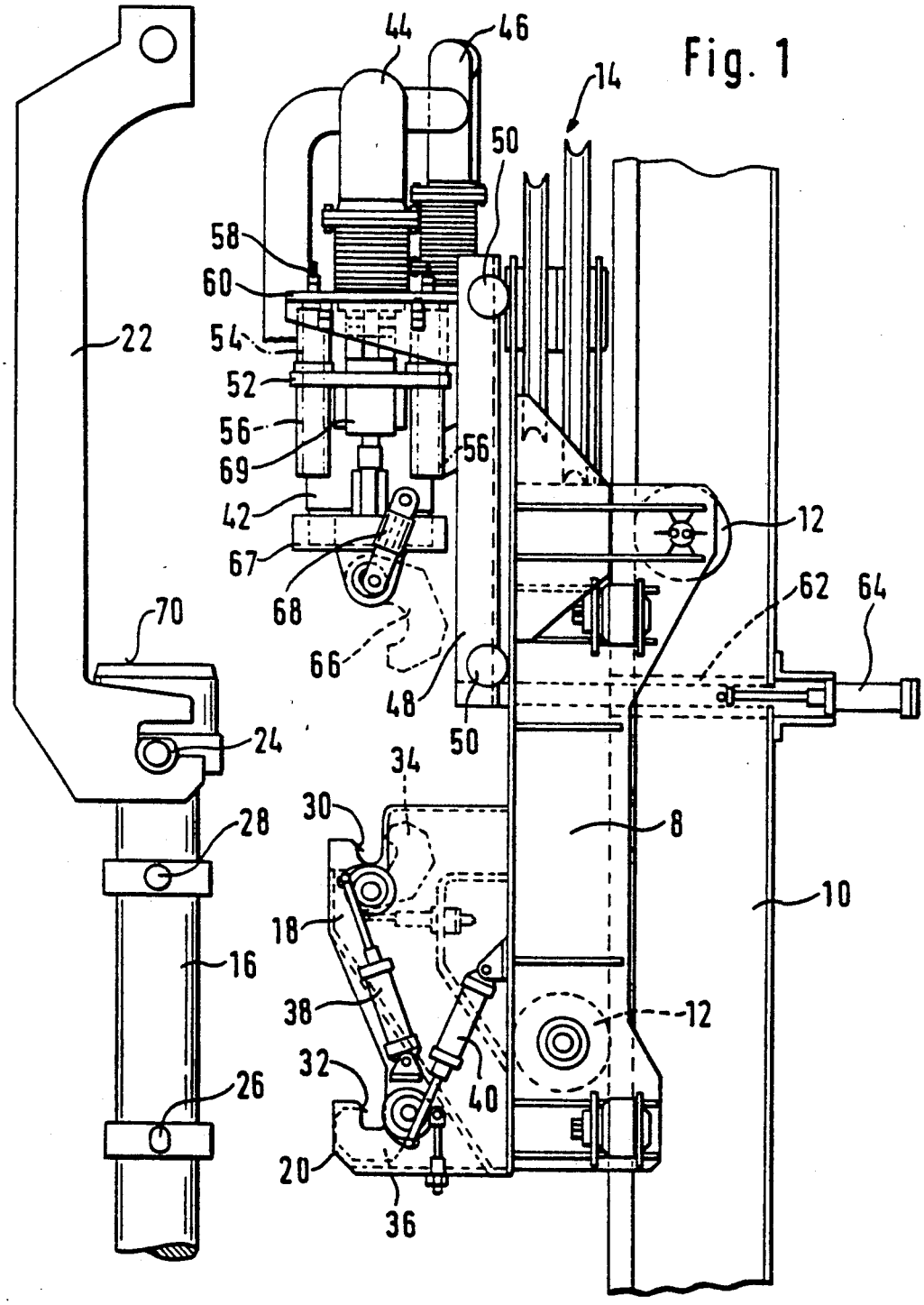
FIGS. 1 to 5 show, in lateral diagrammatic views, a first embodiment with the various sequences of hitching a lance to a manifold.
Figure 2:
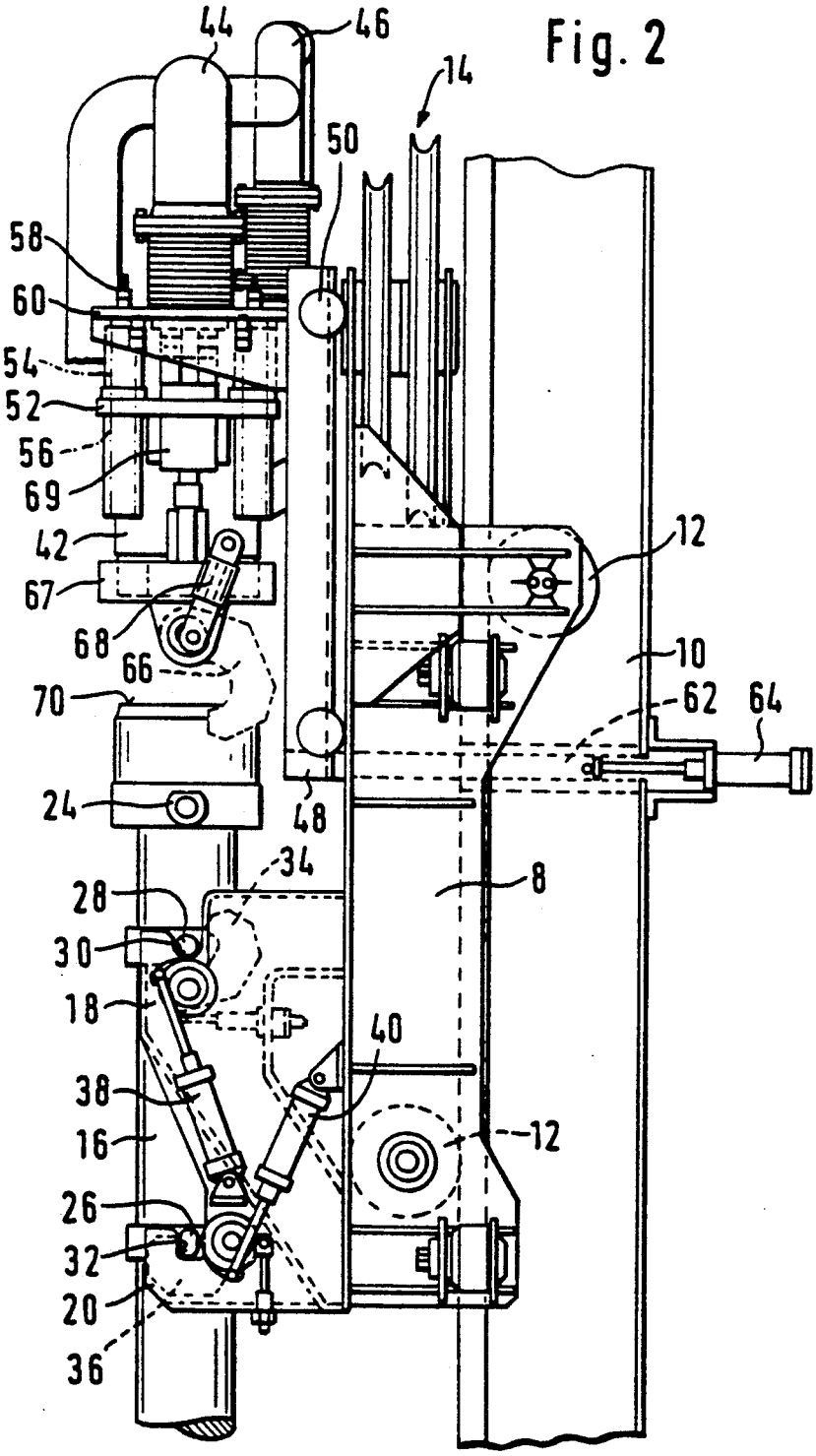
Figure 3:
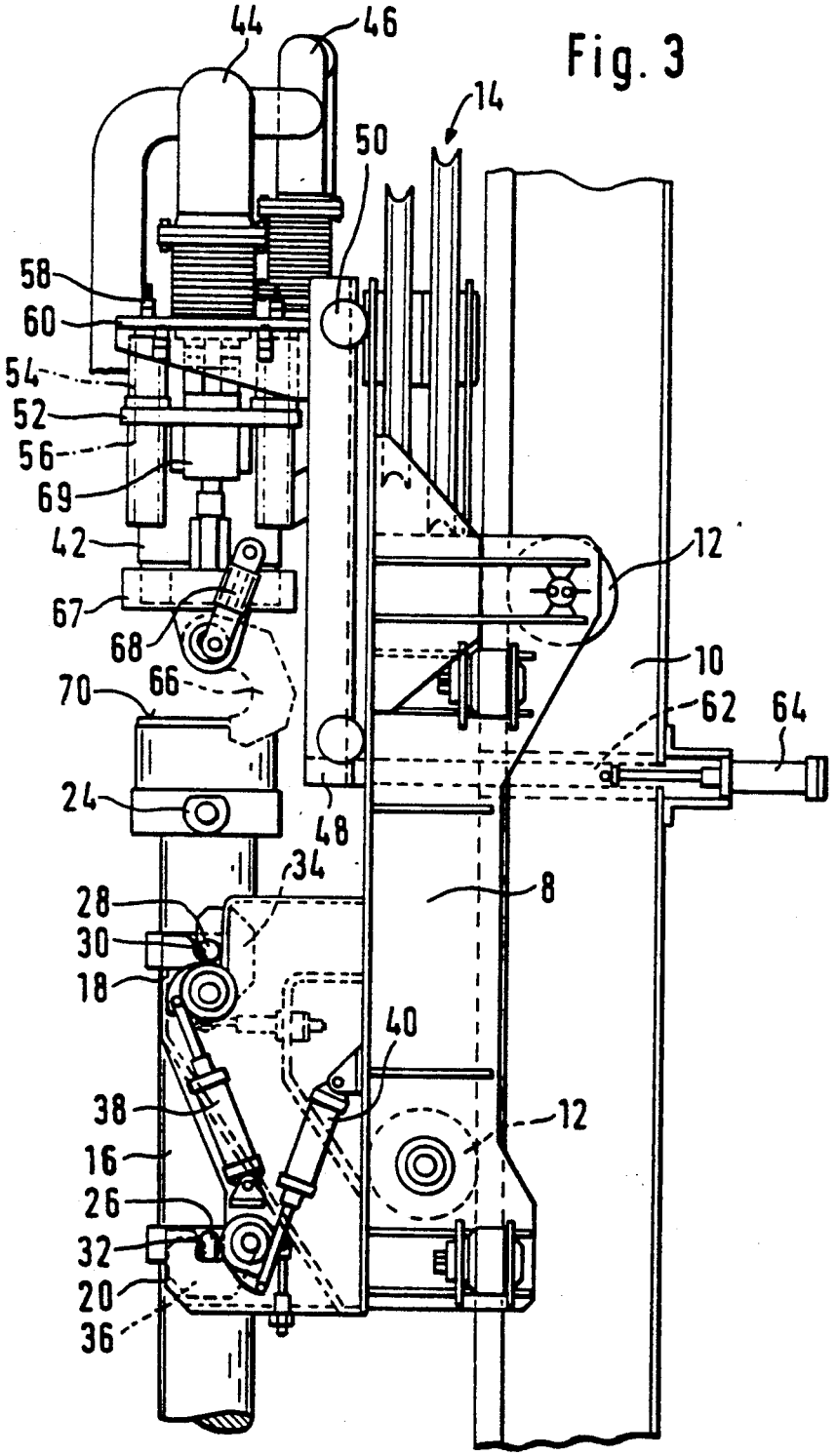

The figures show a lance-carrying carriage 8 designed in order to be displaced vertically, e.g. by means of guide rollers 12 along a slide rail or running track 10, e.g. with the aid of cables or chains running around pulleys 14 in order to dip a lance 16, hitched to the carriage 8, into a converter (not shown) and in order to extract it therefrom.

With a view to the hitching of a lance 16 to the carriage 8, the latter comprises a pair of upper supports 18 and a pair of lower supports 20. In the figures, one of the supports of each pair is hidden by that which can be seen in the figures. The two supports of each pair are sufficiently spaced apart horizontally from each other to enable the lance 16, transported with the aid of a hook 22, to be engaged between them. The two supports 18, 20 are provided with notches 30, 32 corresponding to a pair of upper journals 28 and a pair of lower journals 26 Provided on the lance 16 and by way of which the latter is placed in the notches 30, 32 by means of the hook 22, another pair of journals 24 serving for hitching the lance 16 to the hook 22.

Each of the notches 30, 32 is associated with one or more, preferably two, pairs of upper and lower hooks 34, 36 (only one of the hooks of each of the pairs being visible in the figures) in order to ensure the mounting of the lance 16 in the notches 30, 32 and the rigid connection between the lance 16 and the carriage 8. Each pair of hooks 34, 36 is actuated by one or, preferably, by a pair of jacks 38, 40. The hooks 34 and 36 are mounted as in the document DE-Al 3,828,928 on spindles which are eccentric so as to effect, in a manner known per se, a composite pivoting and translational movement. Under the action of the jack or jacks 38, the hooks 34 pivot about their spindle, followed by a slight lowering movement of their spindle in order to lock the journals 28 in the notches 30. The hooks 36, on the other hand, effect, under the action of the jack or jacks 40, by virtue of their eccentric mounting, essentially a horizontal translational movement of small amplitude in order to jam the journals 26 in the notches 32 or to free them therefrom.

The reference 42 designates a manifold which is in communication with the ducts 44 which transport the refining substances, and with the cooling ducts 46. The way in which these ducts are connected to the manifold 42 and traverse the latter is shown in more detail in the two abovementioned documents illustrating the prior art.

According to one of the features of the first embodiment, the manifold 42 is mounted via resilient means on a manifold-carrying carriage 48 which can slide vertically with respect to the lance-carrying carriage 8 and vice versa, via running rollers 50. The manifold 42 comprises a peripheral flange 52 by way of which it is carried between a group of a plurality of upper helical springs 54 and a group of lower helical springs 56, some of these upper and lower springs being hidden in the figure. Each of these upper and lower springs 54 and 56 are attached via a coaxial rod to a plate 60 which is integral with the manifold-carrying carriage 48. The manifold 42 consequently has a certain freedom of movement between the upper springs 54 and the lower springs 56.

Although the mounting of the manifold 42 via springs on its carriage 48 provides the advantage of greater flexibility, it should be noted that his resilient mounting is not essential since the fact that the lance 16 is no longer carried by the manifold 42, but by its carriage 8, already makes it possible to achieve the desired object.

The proposed device furthermore comprise means for immobilizing the manifold-carrying carriage 48 with respect to the slide rail 10, the lance-carrying carriage 8 remaining, however, free to slide vertically with respect to the manifold-carrying carriage 48 and the slide rail 10. In the example shown, these means consist of a catch 62 which can be displaced horizontally under the action of a jack 64. When the jack 64 is extended, as shown in FIG. 1, the catch 62 penetrates beneath the carriage 48 and forms a stop supporting the carriage and the manifold 42. Instead of providing a sliding catch, it is also possible to provide a pivoting catch.

The various sequences of coupling a lance 16 to the manifold 42 will now be described with reference to FIGS. 1 to 5. A lance 16 is brought into position by the hook 22 and is placed by way of the journals 28 and 26 in the notches 30 and 32. The hook 22 can be lowered until the lance 16 is carried by the journals 28 and 26 in the notches 30, 32, after which the hook 22 can be removed (see FIG. 2). Then, the jacks 38 and 40 are actuated in order to jam the journals 28 and 26 of the lance 16 in the notches 30 and 32 (see FIG. 3) and to make the lance 16 completely integral with the carriage 8.

Figure 4:
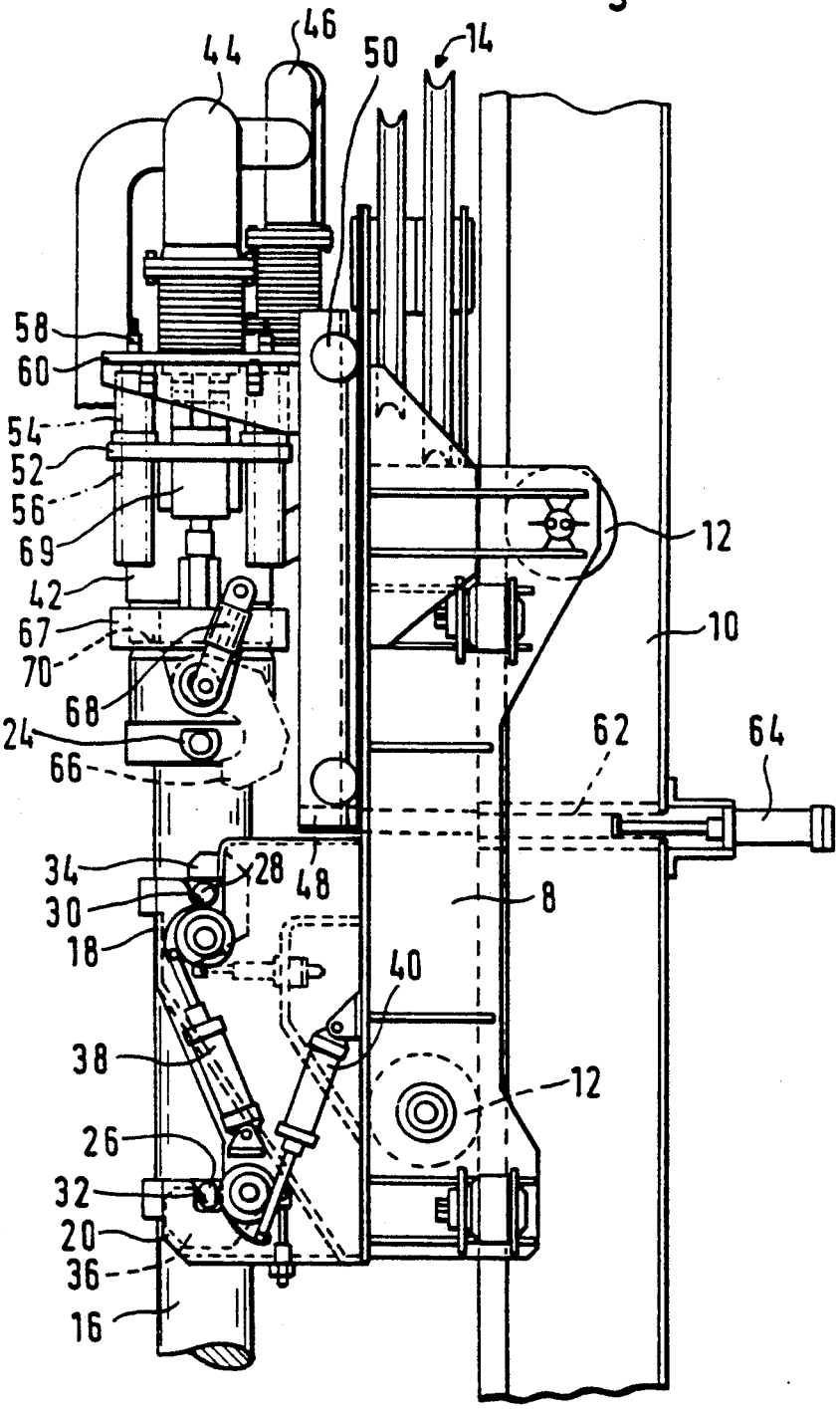

The next step, shown in FIG. 4, consists in effecting the coupling between the manifold 42 and the joint face 70 of the lance 16. For this purpose, the manifold 42 comprises a pair of hooks 66 which are actuated under the effect of eccentrically pivoting connecting rods when the pate 67 is displaced by hydraulic jacks 69. These hooks 66 are comparable with the hooks 34, in other words they are mounted on a spindle which, when it pivots, effects a slight translational motion in the vertical direction by virtue of the connecting links which are eccentric with respect to the spindle of the hooks.

Figure 5:
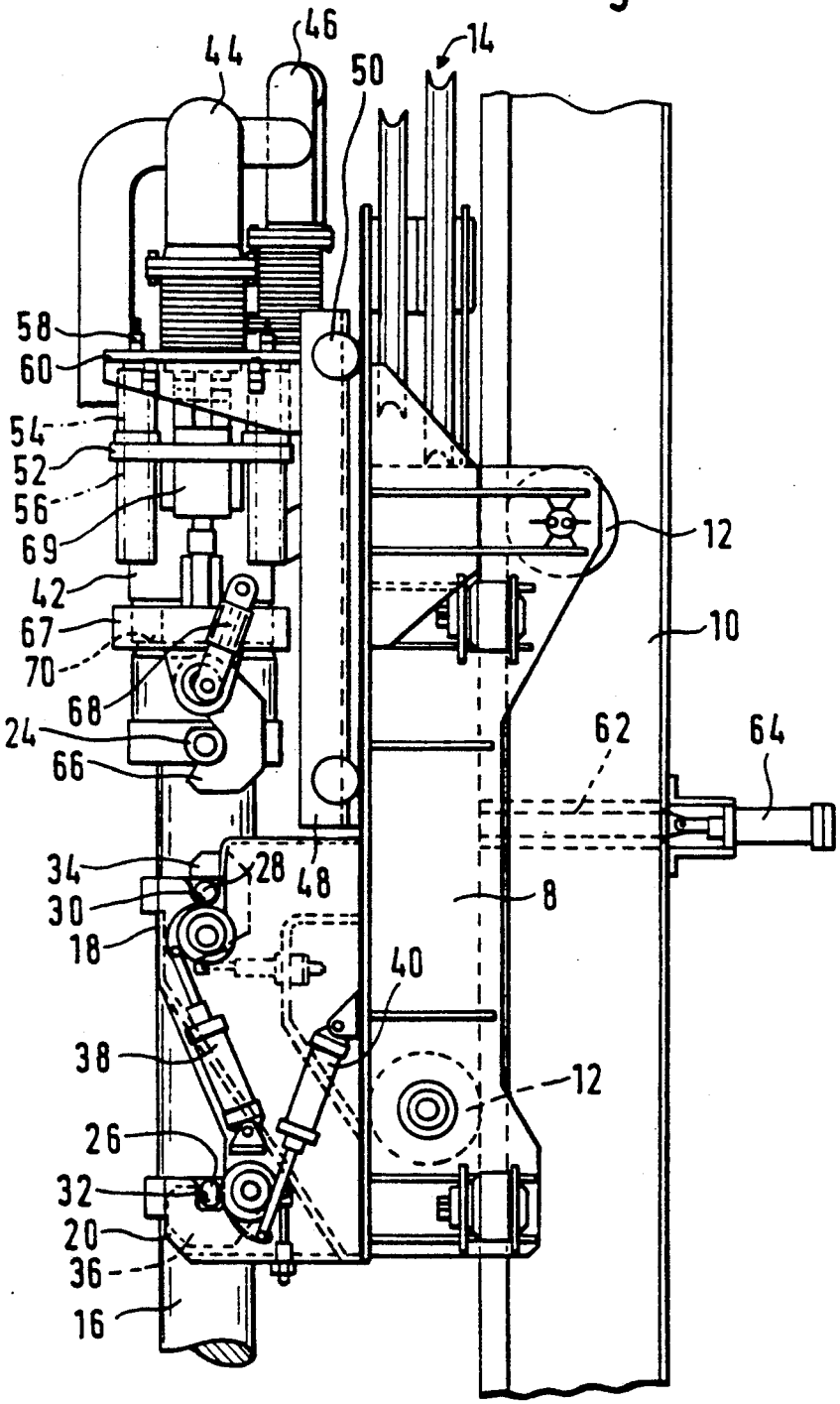

With a view to the coupling, the lance-carrying carriage 8 is raised into the position in FIG. 4 until the joint face 70 of the lance 16 is in contact with the lower face of the manifold 42, or in immediate proximity to this face which, for this purpose, can comprise a socket for receiving the lance 16 with the appropriate seals. Then, the jacks 68 are actuated in order to close the hooks 66 and to hitch on the journals 24, as shown in FIG. 5. The manifold 42 is from then on entirely integral with the lance 16 and, consequently, with the lance-carrying carriage 8.

The next operation consists of actuating the jack 64 and retracting the rod of the latter in order to release the catch 62 from the manifold-carrying carriage 48 (FIG. 5) and to free the latter with respect to the slide rail 10. The carriage 48 is then supported by the lance-carrying carriage 8 via the springs 54, 56, the manifold 42 and the lance 16. All that needs to be done then in order to dip the lance 16 into the converter is to lower the assembly formed by the two carriages 8 and 48 along the slide rail 10.

The disassembly of a lance 16 follows, of course, the same procedure in reverse, in other words initially raising the carriage 8 in order to remove the lance 16 from the converter, maneuvering the jack 64 in order to fasten the manifold-carrying carriage 48, opening the hooks 66, lowering the lance-carrying carriage 8, opening the hooks 34 and 36 and detaching the lance 16 via the hook 22.

Figure 6:
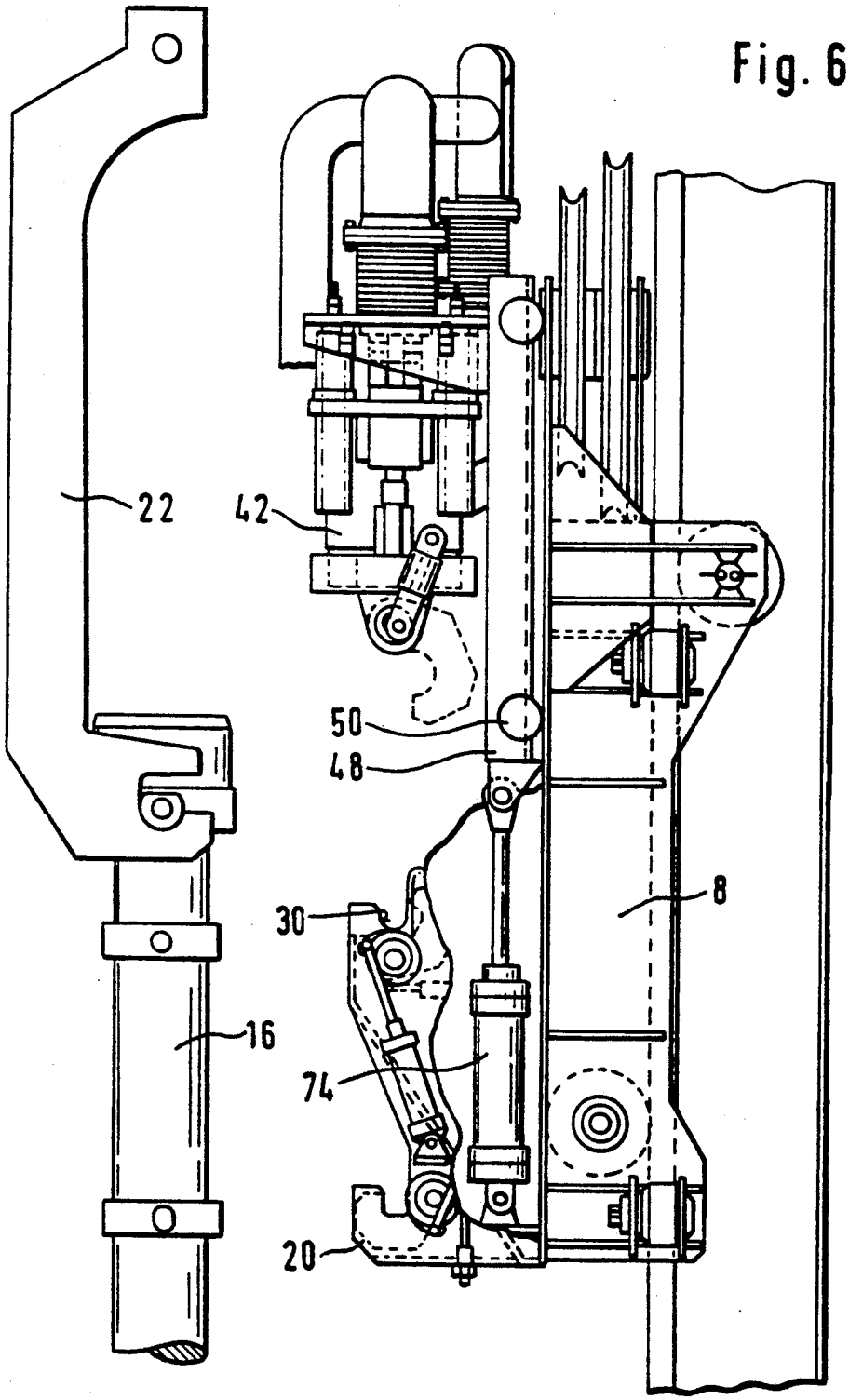
FIG. 6 shows an alternative of the embodiment of FIGS. 1–5.

FIG. 6 shows an alternative of the above embodiment which makes it possible to dispense with the catch 62 and its jack 64. According to this alternative, the manifold-carrying carriage 48 is supported by a jack 74 or two jacks 74 which is or are integral with the lance-carrying carriage 8. When a lance is changed, the lance-carrying carriage 8, with the lance 16, remains stationary, while the manifold-carrying carriage 48 is displaced under the action of the jack 74 in order to effect the approaching or releasing maneuvers between the manifold and the lance, in contrast to the embodiment according to FIGS. 1 to 5 in which the lance-carrying carriage 8 is displaced, while the manifold-carrying carriage 48 remains stationary. The advantage of this alternative is that the winch and the pulleys 14 do not need to be actuated when a lance is changed.

Figure 7:
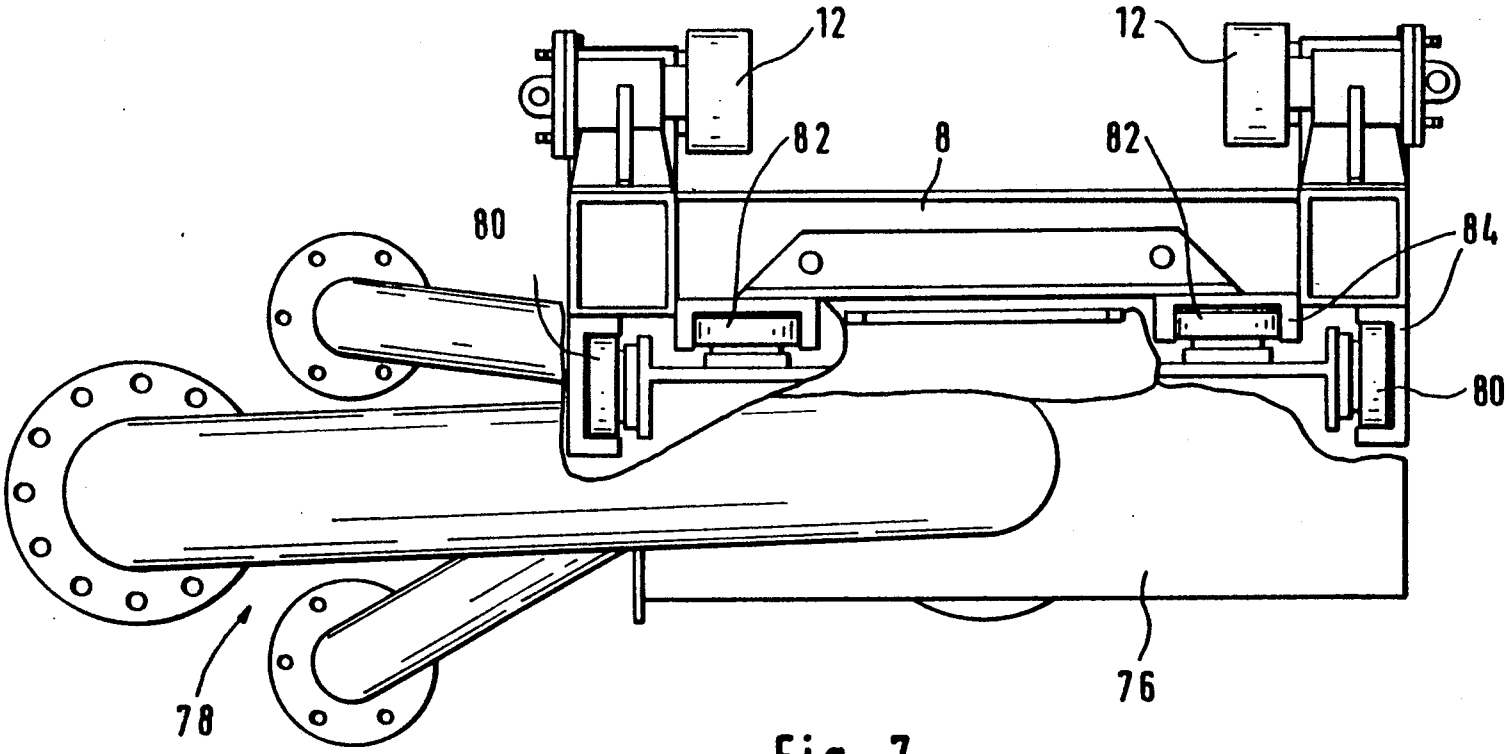
FIG. 7 shows a view, from above, of a second embodiment.

FIG. 7 shows a top view of a second embodiment. The reference 8 designates a lance-carrying carriage with its rollers 12 identical to those of the first embodiment. The reference 76 designates the manifold with its connection pipes 78. In contrast to the first embodiment, the manifold 76 is no longer supported by a carriage but is equipped directly with running rollers 80 and with guide rollers 82 which move along in corresponding vertical rails 84 of the lance-carrying carriage 8 and enable the manifold 76 to slide vertically with respect to the carriage 8. The vertical support of the manifold 76 can be affected either, following the example of FIGS. 1 to 5, by means of the lance 16 and a catch 62 (not shown), or, according to FIG. 6, with the aid of a jack (not shown).

The advantage of the embodiment in FIG. 7 is a more simple, more compact and more robust construction.

While preferred embodiments have been shown and described, various modifications and substitutions may be made thereto without departing from the spirit and scope of the invention. Accordingly, it is to be understood that the present invention has been described by way of illustrations and not limitations.

What is claimed is:

1. A device for the automatic coupling of a lance for injecting a fluid into a molten metal bath to a manifold for supplying fluid to the lance, comprising:

a vertically displaceable lance-carrying carriage slidably mounted on a slide rail;

means for rigidly securing said lance to said lance-carrying carriage;

means for supporting said manifold with respect to said lance-carrying carriage, said means for supporting allowing vertical displacement of said lance-carrying carriage relative to said manifold.

2. The device of claim 1, wherein said means for supporting said manifold comprises:

a vertically displaceable manifold-carrying carriage slidably mounted to said lance-carrying carriage; and means for mounting said manifold on said manifold-carrying carriage.

3. The device of claim 2, further comprising immobilizing means for immobilizing said manifold-carrying carriage with respect to the slide rail.

4. The device of claim 3, wherein said immobilizing means comprises:

catch means for supporting said manifold-carrying carriage at a stop position with respect to said slide rail.

5. The device of claim 3, wherein said immobilizing means comprises:

means for supporting said manifold-carrying carriage at a stop position with respect to said slide rail, said support means being integral with said lance-carrying carriage.

6. The device of claim 3, further comprising guide roller means for displacing the lance-carrying carriage relative to the manifold-carrying carriage, where the manifold-carrying carriage is immobilized relative to the slide rail.

7. The device of claim 6, further comprising a catch for supporting the manifold-carrying carriage with respect to the slide rail and jack means for displacing the catch.

8. The device of claim 1, further comprising jack means, mounted on the lance carrying carriage when the lance is changed.

9. The device of claim 1, wherein said means for supporting said manifold comprises roller means in communication with said lance-carrying carriage, said roller means being directly attached to said manifold.

10. The device of claim 1, wherein the lance further comprises two pairs of journals, the lance carrying carriage further comprises two pairs of supports and each support includes notches for receiving and carrying the journals, said device further comprising a plurality of hooks, each of said hooks being associated with a respective one of said notches, for rigidly connecting the lance to the lance-carrying carriage and jack means for actuating said hooks.

11. The device of claim 1, wherein the manifold further comprises hook means for securing the manifold to the lance.

12. The device of claim 11, wherein the hook means comprises a pair of pivotably mounted hooks, a pair of jacks for displacing the respective hooks and a pair of connecting rods, oriented eccentrically with respect to the pivotal axis of the hooks, for connecting each of the jacks to a respective one of the hooks.

13. The device of claim 2, wherein said means for mounting comprises resilient means for resiliently mounting said manifold-carrying carriage.

14. The device of claim 13, wherein the manifold-carrying carriage further comprises a plate, the manifold further comprises a peripheral flange and the resilient means comprises a plurality of vertical oriented springs fixed between the plate and the flange.

* * * * *